United States Patent [19]

Sando et al.

[11] 4,182,140

[45] Jan. 8, 1980

[54] CLOTH CLEANING METHOD WITH STEAMING AND LIQUID FLOW AND AN APPARATUS THEREFOR

[75] Inventors: Yoshikazu Sando; Hiroshi Ishidoshiro, both of Wakayama, Japan

[73] Assignee: Sando Iron Works Co., Ltd., Wakayama, Japan

[21] Appl. No.: 884,847

[22] Filed: Mar. 9, 1978

[30] Foreign Application Priority Data

| | | | |
|---|---|---|---|
| Mar. 16, 1977 | [JP] | Japan | 52-29024 |
| May 31, 1977 | [JP] | Japan | 52-63524 |
| Jul. 26, 1977 | [JP] | Japan | 52-99898[U] |

[51] Int. Cl.[2] ..... D06B 3/12; D06B 21/02

[52] U.S. Cl. ..... 68/5 E; 68/13 R; 68/62; 68/181 R; 68/183

[58] Field of Search ..... 68/5 E, 9, 19, 13 R, 68/177, 178, 183, 181 R, 62; 8/151

[56] References Cited

U.S. PATENT DOCUMENTS

| | | | |
|---|---|---|---|
| 242,045 | 5/1881 | Reilly | 68/9 |
| 1,497,075 | 6/1924 | Elliott | 68/5 E |
| 2,785,042 | 3/1957 | Grajeck et al. | 8/151 |
| 3,686,905 | 8/1972 | Stanway | 68/177 X |
| 3,950,802 | 4/1976 | Schiffer et al. | 68/181 R X |
| 3,958,432 | 5/1976 | Aronoff | 68/13 R |

FOREIGN PATENT DOCUMENTS

| | | | |
|---|---|---|---|
| 2521600 | 11/1976 | Fed. Rep. of Germany | 68/181 R |
| 2527734 | 1/1977 | Fed. Rep. of Germany | 68/181 R |

*Primary Examiner*—Philip R. Coe

*Attorney, Agent, or Firm*—Toren, McGeady and Stanger

[57] ABSTRACT

In apparatus for cleaning cloth with steam and liquid flow, a cloth such as a textile, knitted fabrics or a tubular knitted material, is supplied into a chamber containing wet heat of about 105° to 110° C., then it is made to advance in a left and right zigzag manner, further the cloth is contacted with a cleaning liquid flowing down from the upper part of the chamber.

1 Claim, 5 Drawing Figures

CLOTH CLEANING METHOD WITH STEAMING AND LIQUID FLOW AND AN APPARATUS THEREFOR

FIELD OF THE INVENTION AND BACKGROUND OF THE INVENTION

The present invention relates to an apparatus for cleaning cloth with steam and liquid flow in which the cloth can be effectively cleaned in a continuous manner while saving on water consumption.

A cloth needs to be cleaned in a continuous manner before and after dyeing, scouring, bleaching and resin finishing, etc. in an industrial production thereof. It is well known that a large amount of water is consumed in the cleaning of the cloth, and nowadays it is necessary to limit the consumption of water used in cleaning cloth because of the scarceness of water resources.

However, in conventional cleaning apparatus the saving of cleaning water has not been realized and a large amount of water resources is still consumed.

SUMMARY OF THE INVENTION

Accordingly, the object of the present invention is to provide an apparatus in which a cloth is cleaned continuously while the amount of water used in cleaning is reduced and the cleaning process is carried out efficiently.

Further objects of the present invention can be expressed concretely as follows:

(a) a cloth to be cleaned is steamed under an atmosphere of 100° C. and above to swell the fiber of the cloth so that it can be easily cleaned, (b) thus swollen cloth is contacted with hot cleaning water as it is advanced in a zigzag manner for conducting the cleaning, (c) cleaning water is saved by a liquid circulation means which sends hot cleaning water which has been accumulated in a lower tank to an upper part by a pump or pumps and the recirculated hot water is dropped onto the cloth being advanced in a zigzag manner, (d) a tubular cloth knitted in a tubular manner is cleaned effectively and continuously without causing the same to be stretched in its longitudinal direction.

DESCRIPTION OF THE PREFERRED EMBODIMENTS

Now, examples of the present invention which have been made to achieve these objects will be explained in detail referring to the drawings attached.

BRIEF DESCRIPTION OF THE DRAWINGS

The drawings show examples of a cloth cleaning apparatus using steam and a flowing liquid in accordance with the present invention.

EXAMPLE 1

Figure 1:
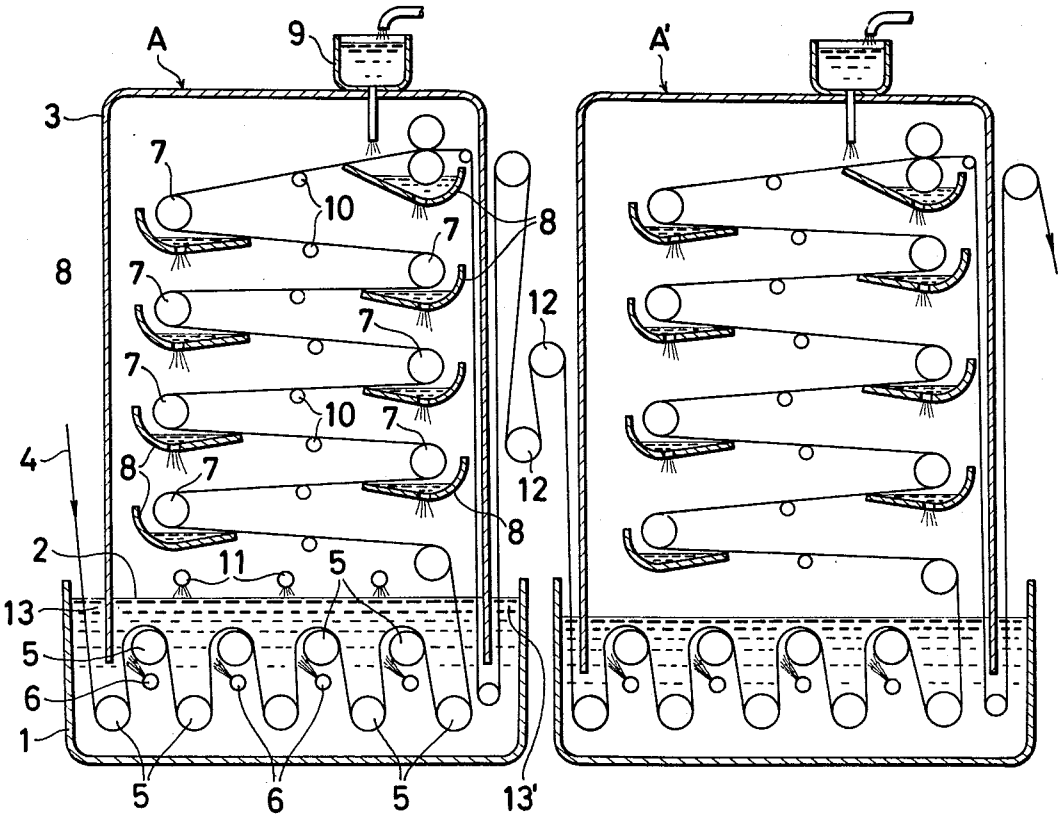
FIG. 1 is a cross sectional view showing a first example.

In FIG. 1 an entire cleaning apparatus A, A' is shown, and since the structure of the cleaning apparatus (A) and the apparatus (A') is the same, an explanation will be made only of the cleaning apparatus (A).

In FIG. 1, a liquid tank 1 is shown having its upper end opened, and the inside of the liquid tank (1) is filled with cleaning liquid such as hot water etc. A vertical chamber 3 has its lower end opened which has a smaller diameter than the diameter of the liquid tank (1), and the edge of the lower opening of the vertical chamber extends into the cleaning liquid (2) in the liquid tank (1) so that the inside of the vertical chamber (3) is kept air-tight. A number of guide rolls (5) located in the liquid tank 1 in two stages, advance a tubular knitted cloth (4) in a zigzag manner in up and down manner, and air jet pipes (6) located close to the upper guide rolls supply air between the upper stage guide rolls (5) and the cloth (4). Also a number of guide rolls (7) in the vertical chamber 3 advance the cloth (4) in a left and right zigzag manner. The guide rolls 7 are provided in multi-stages vertically and in two rows, left and right. Further, a hot water washing dish (8) is provided underneath each guide roll (7), and each hot water washing dish (8) is filled with hot water which flows downwardly from a hot water tank (9) through the tubular knitted fabric (4) from one dish to another or flows out of a hot water washing dish in an upper stage. Guide rolls 10 prevent the cloth (4) from sagging, and steam jet pipes 11 deliver steam inside of the vertical chamber (3), so that the interior of the vertical chamber (3) can be maintained with wet heat of about 105° to 110° C. by the steam from said steam jet pipes and by the air-tightness within the vertical chamber (3) by the liquid sealing action of the cleaning liquid (2) within the liquid tank (1). Tension adjusting rolls 12 for the cloth are located outside the vertical chamber 3 and above the liquid tank 1. Also the hot water within the liquid tank (1) is fed back to the hot water tank (9) by a pump or pumps (not shown in the drawing).

Next, the function of the apparatus will be explained. First, the cloth (4) to be cleaned is fed into the liquid tank (1) through gap (13) formed between the liquid tank (1) and the vertical chamber (3) and is advanced in a zigzag manner through the cleaning liquid (2) by each of the guide rolls (5) provided within the liquid tank (1). The air blown from the air jet pipes (6) is directed between the cloth (4) and the guide rolls (5) as the cloth advances in a zigzag manner, therefore the air penetrates through the fabric of the cloth by a pressure contacting power between the cloth and the guide rolls (5), thus cleaning between the fabric of the cloth is also effectively done. The cloth which has received a primary cleaning within the cleaning tank (1) is guided by each of the guide rolls (7) within the vertical chamber (3) in which wet heat of about 105° C. is maintained by thermal energy from the steam jet pipes (11) and the cloth ascends in a vertical zigzag manner within the vertical chamber and repeatedly receives a contacting pressure with each of the guide rolls (7) and hot cleaning water drops from the hot water washing dish (8) opposingly provided at each of the guide rolls as it ascends, thus the cloth receives a secondary cleaning within the vertical chamber (3). The cloth (4) having received a secondary cleaning descends and is guided out of the first stage cleaning apparatus (A) through a gap (13') formed between the liquid tank (1) and the vertical chamber (3). Then the cloth is fed into the next stage cleaning apparatus (A') after passing over tension adjusting rolls (12) to undergo a similar cleaning as before. While the steam jet pipes (11) are provided within the vertical chamber (3) in this example, the steam jet pipes (11) may be provided in the liquid tank (1).

Thus far the cleaning function in this example has been explained, now its effect will be explained. In the primary cleaning in the liquid tank (1), air is blown in between the cloth (4) and the guide rolls (5) so that the cleaning liquid penetrates through the fabric of the cloth as air penetrates through the cloth, thus the cleaning effect is enhanced. Further, a large effect afforded by the present invention is that the inside of the vertical chamber (3) is maintained with wet heat of 105° C. or above. That is, as the cloth being cleaned is passed through the wet heat of 105° C. or above, its degree of swelling is enhanced so that the flowability of the cleaning liquid into the inside of the cloth fabric is enchanced thus cleaning is satisfactorily done.

Moreover, a liquid flow system is employed in the present invention so that the cloth is made to contact repeatedly the cleaning liquid which is flowing downwardly and the downwardly flowing cleaning liquid is pumped up and reused, therefore, effective cleaning is accomplished with a small amount of cleaning liquid, thus a cleaning apparatus which allows a savings in the amount of water consumed can be provided.

Furthermore, the present invention has the effect that a high speed cleaning can be done reducing the cleaning time in half or less than that required for a conventional cleaning with wet heat of below 100° C. (actually 95° C.), because the cleaning process in the present invention is done under wet heat of 105° C. or above.

While the example discussed has a cleaning apparatus (A) and a cleaning apparatus (A') provided in a line and uses hot water as the cleaning liquid in both apparatus (A) and (A'), the present invention is not limited to this set-up, instead a cleaning liquid having chemical agent etc. mixed therein may be used in the apparatus (A) and water or hot water may be used in the apparatus (A') to clean up the cleaning liquid of the apparatus (A), thus different kinds of cleaning liquid may be selected as desired, and the apparatus (A) and the apparatus (A') do not have to be used as a pair, instead only one cleaning apparatus or more than two cleaning apparatuses may be used as required.

EXAMPLE 2

Figure 2:
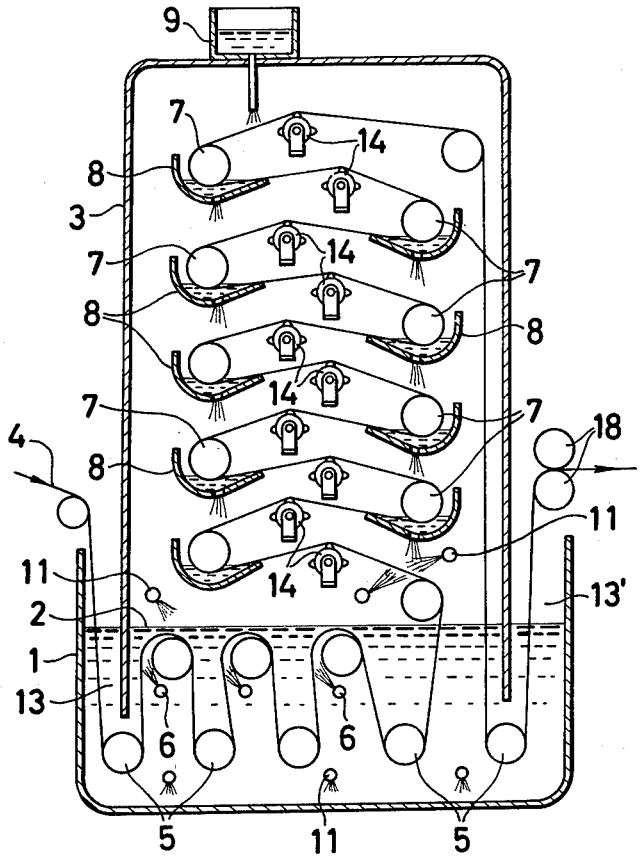
FIG. 2 is a cross sectional view showing a second example.
Figure 3:
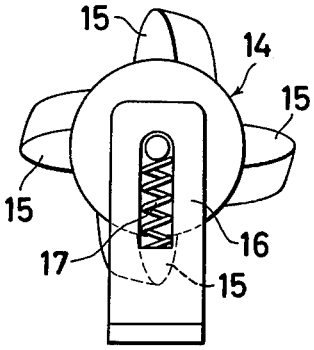
FIG. 3 is a side elevation showing a fluttering and stretching roll used in the second example and its supporting mechanism.
Figure 4:
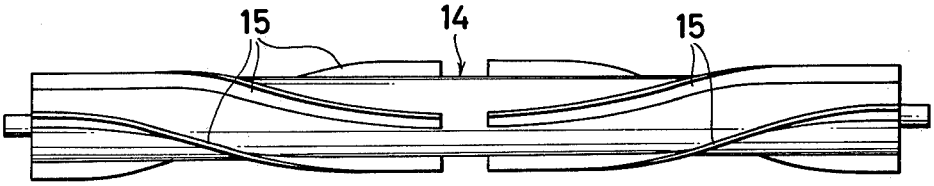
FIG. 4 is a plan of the fluttering and stretching roll only.

In FIGS. 2 to 4, a liquid tank 1 is shown with its upper end opened and filled with a cleaning liquid (2) such as hot water, etc. A vertical chamber 3 is shown with its lower end opened and the diameter of the opening is smaller than the diameter of the liquid tank (1). The edge of the lower opening of the vertical chamber 3 extends into the cleaning liquid (2) in the liquid tank (1), thus the inside of the vertical chamber (3) is maintained air tight. A number of guide rolls (5) advance a cloth (4) in an up and down zigzag manner within the tank 1. The guide rolls are arranged in an upper and a lower stage within the liquid tank (1). Further, air jet pipes (6) supply air between the upper stage guide rolls (5) and the cloth (4) at positions close to the upper stage guide rolls (5). A number of guide rolls (7) located in the vertical chamber 3 advance the cloth (4) in a left and right zigzag manner. The guide rolls are provided in vertical multi-stages and in a left and a right row in the vertical chamber (3). Furthermore, a hot water washing dish (8) is provided beneath each of the guide rolls (7), and each hot water washing dish (8) is filled with hot water which flows down from a hot water tank (9) and drops through a tubular knitted textile (4) or it flows out of an upper hot water washing dish.

Fluttering and stretching rolls 14 are shown for the cloth and are positioned between the left and right rows of guide rolls (7) so that they contact the cloth (4). The fluttering and stretching rolls (14) have projecting rails (15) formed on their circumferential surfaces and the rails are slanted from the centers of the rolls towards both ends, as shown in FIG. 3 and FIG. 4. Further, the fluttering and stretching rolls (14) are elastically retained through the elastic power of springs (17) at bearings (16) fixed to the inside of the vertical chamber (3) so that the tension of the cloth is absorbed. Squeezing rolls 18 squeeze the cloth. Moreover, each of the fluttering and stretching rolls (14) is rotated at an appropriate speed by a driving means (not shown in the drawing) such as a motor, etc.

Since water adhering to the cloth is splashed away then new water comes in contact with the cloth, and replenishing and renewal of the cleaning water is effectively carried out, further, a cloth stretching function is provided by the projection rails so that the cleaning process is performed without generating creases or wrinkles in the cloth. The cloth is taken out of the apparatus through a gap (b) and the squeezing rolls (18).

As has been explained above, in this example, when the cloth is made to swell up within the vertical chamber (3) holding wet heat of 105° C. or above and is made to contact hot water repeatedly for effecting a cleaning of the cloth, a fluttering action is repeatedly given to the cloth by the fluttering and stretching rolls (14) so that the renewal and replenishing of the cleaning liquid being absorbed by the cloth can be satisfactorily done, thus providing the advantages that effective cleaning can be afforded within a short period of time with an effective reduction in water consumption. In addition the cloth can be processed and advanced without generating creases and wrinkles by the cloth stretching function of the fluttering and stretching rolls (14).

Since each of the fluttering and stretching rolls (14) is elastically supported, there is such advantage that when the tension on the cloth varies as the cloth is fluttered and a rather strong tension acts on the cloth, such abnormal tension can be effectively absorbed by the springs (17) which support the fluttering and stretching rolls.

EXAMPLE 3

Figure 5:
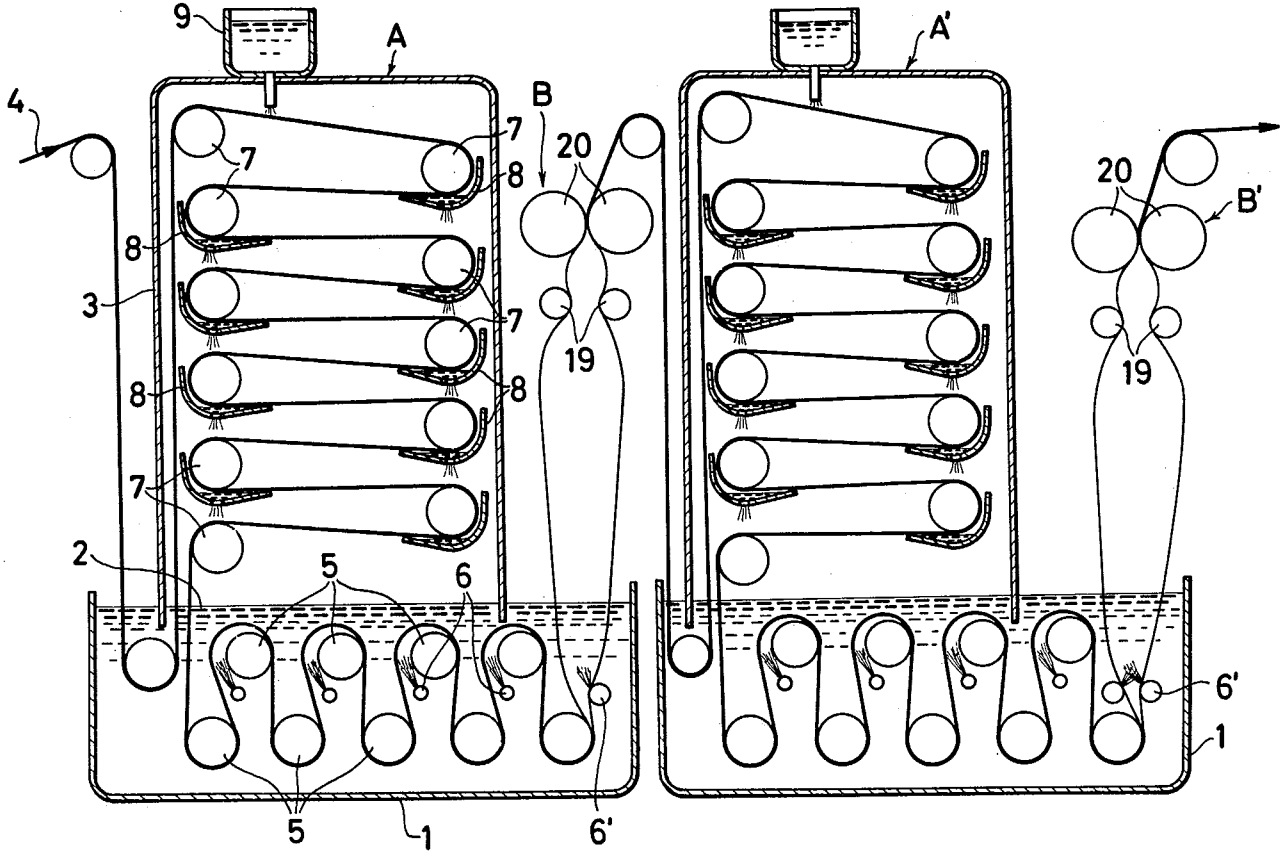
FIG. 5 is a cross sectional view showing a third example of the present invention.

In FIG. 5, cleaning apparatuses A, A' are shown, and since the structures of the cleaning apparatuses (A) and (A') are the same as those shown in Example 1, and a number of the component parts thereof are made to correspond to those in FIG. 1, explanations thereof will be omitted. Cloth stretching mechanisms B, B' for a tubular cloth textile are provided next to the cleaning apparatuses (A) and (A'), respectively. The cloth stretching mechanism (B) consists of air jet pipes (6') provided near an outlet from the liquid tank (1), a pair of separate rolls (19) provided above the air jet pipes (6') and outside of both the liquid tank (1) and the vertical chamber (3), and a pair of pressing rolls (20) positioned above the separate rolls. The structure of the cloth stretching mechanism (B') is similar to that just mentioned.

Therefore in this example, a tubular cloth (4) is cleaned in the cleaning apparatuses (A) and (A') and when it is taken out of the cleaning apparatuses, air is supplied to inside of the tubular cloth (4) from the air jet pipes (6') so that the tubular knitted textile is expanded into a tubular shape and the expanded tubular cloth is pressed by the pair of separate rolls (19) into a relatively flat shape, therefore, it is stretched in its transverse direction, thus stretching of the cloth in its longitudinal direction generated during the cleaning operation is eliminated and at the same time creases and wrinkles in the tubular cloth are eliminated. Therefore, this example has the effect that a tubular knitted cloth, after a cleaning process or processes, can be advanced to the next process without having creases and wrinkles or longitudinal stretching.

What is claimed is:

1. A cloth cleaning apparatus utilizing steam and a flowing liquid for cleaning a tubular knitted material, comprising a liquid tank having a liquid level therein, said tank having an open upper end and closed lower end and sides extending between the lower end and upper end, a vertical chamber located above said liquid chamber and having an open lower end and a closed upper end, the lower end of said vertical chamber extends downwardly through the open upper end of said liquid tank below the liquid level therein and above the lower end of said liquid tank so that the liquid in said tank forms a liquid seal for said vertical chamber, the sides of said liquid tank being spaced outwardly from said vertical chamber at the lower end thereof for forming a gap therebetween for passing the tubular knitted material being cleaned into and out of said liquid tank so that it passes below the liquid level therein, a plurality of horizontally arranged vertically space guide rolls located within said vertical chamber and arranged in two horizontally spaced vertically extending rows for guiding the material in a zigzag manner through said vertical chamber, a washing dish arranged in juxtaposition to and below each of said guide rolls, a cleaning liquid tank for supplying cleaning liquid into the upper end of said vertical chamber for flow into the uppermost one of said washing dishes so that the cleaning liquid flows by gravity downwardly to the lower said washing dishes and into said liquid tank so that the cleaning liquid can be collected in said liquid tank for recirculation to said cleaning liquid tank, steam jet pipes located in one of said vertical chamber and liquid tank for maintaining wet heat at least at 105° C. within said vertical chamber, a plurality of horizontally arranged fluttering and stretching rolls located within said vertical chamber so that each said fluttering and stretching rolls is positioned between a pair of said guide rolls with the guide rolls of each said pair located each in a different one of said rows of guide rolls so that said fluttering and stretching rolls impart a fluttering action and a stretching action to the tubular knitted material passing over said guide rolls, an air jet pipe located in the path of the tubular knitted material passing out of said liquid tank for supplying air into the tubular knitted material for swelling the material into its tubular shape, pressing rolls in the path of the swollen tubular knit material for pressing the tubular knitted material and stretching it in the direction transverse to its longitudinal direction, and rolls for retaining the stretched width of the tubular shaped material which has been stretched by the pressing rolls and for guiding the advance of the tubular knitted material.

* * * * *